US006776710B1

(12) United States Patent
Messmer et al.

(10) Patent No.: US 6,776,710 B1
(45) Date of Patent: Aug. 17, 2004

(54) VENT STRUCTURE FOR SLOTTED OUTLET WITH UNIFORM VELOCITY PROFILE

(75) Inventors: Craig Messmer, St. Louis, MO (US); Richard Eason, St. Louis, MO (US)

(73) Assignee: Unico, Inc., St. Louis, MO (US)

( * ) Notice: Subject to any disclaimer, the term of this patent is extended or adjusted under 35 U.S.C. 154(b) by 0 days.

(21) Appl. No.: 10/693,436

(22) Filed: Oct. 24, 2003

(51) Int. Cl.[7] ..... F24F 13/06

(52) U.S. Cl. ..... 454/305; 34/97; 454/188; 454/306

(58) Field of Search ..... 454/153, 284, 454/305, 306, 188; 34/97

(56) References Cited

U.S. PATENT DOCUMENTS

| | | | | | |
|---|---|---|---|---|---|
| 69,530 | A | | 10/1867 | Adams | |
| 1,948,909 | A | | 2/1934 | Evans | |
| 1,951,269 | A | * | 3/1934 | Boeckx et al. | 132/212 |
| 2,011,141 | A | | 8/1935 | Bergstrom | |
| 2,295,251 | A | | 9/1942 | Baker | |
| 2,684,690 | A | * | 7/1954 | Lee | 137/601.08 |
| 2,820,406 | A | | 1/1958 | Argentieri | |
| 3,389,648 | A | * | 6/1968 | Larkfeldt et al. | 454/322 |
| 3,642,093 | A | | 2/1972 | Schach | |
| 5,052,284 | A | | 10/1991 | Schweikert | |
| 5,052,285 | A | | 10/1991 | Rich | |
| 5,356,336 | A | * | 10/1994 | Stouffer et al. | 454/155 |

* cited by examiner

*Primary Examiner*—Harold Joyce
(74) *Attorney, Agent, or Firm*—Thompson Coburn LLP

(57) ABSTRACT

A vent structure comprises an inlet-connector section, an outlet section, and a transition section between the inlet-connector section and outlet section. The inlet-connector section is at an inlet end of the vent structure and is adapted for connection with an inlet duct from which the vent structure receives a flow of air. The outlet section is at an outlet end of the vent structure and includes an outlet slot that is adapted to direct the flow of air into a room. The transition section has a flared portion that diverges in cross-sectional area as it extends generally toward the outlet section. The transition section has a constricted portion located between the inlet-connector section and the outlet slot. The constricted portion is also located substantially centrally within a plane that is generally perpendicular to a direction of air flow. The constricted portion is adapted to restrict the flow of air through a central portion of the transition section, thereby restricting the flow of air exiting a corresponding central portion of the outlet slot to provide a more uniform velocity profile of exiting air.

26 Claims, 4 Drawing Sheets

VENT STRUCTURE FOR SLOTTED OUTLET WITH UNIFORM VELOCITY PROFILE

BACKGROUND OF THE INVENTION

The present invention relates to heating, ventilating and air conditioning (HVAC) systems for controlling environmental conditions in a room or space. More particularly, the present invention relates to an HVAC system vent structure, which is configured to provide a uniform velocity profile of exiting air.

In conventional building construction, HVAC ducts are formed of sheet metal and have rectangular cross sections. The ducts and outlet registers have cross sectional areas in the range of tens of square inches. Within conventional stud wall sections, the ducts often occupy most of the space between a pair of adjacent studs. Conventional home environmental systems move heated or cooled air at relatively low velocities.

In some newer ducting designs, cylindrical ducts are used which have much smaller cross sectional areas than more conventional ducts, in the range of less than ten square inches. Airflow through such smaller ducts is at a higher velocity than in conventional ducts to achieve comparable volumetric flow rates and to promote better mixing of conditioned air into the ambient air within a room. These smaller ducts typically have a lower manufacturing cost because less material is used, and because manufacturing labor is reduced. Additional advantages include more convenient installation and higher energy efficiency, because there is less surface area through which heat can be transferred.

A common problem with any vent structure is the generation of audible noise by air flowing through the vent structure and louvers. Airflow noise is generally caused by turbulence resulting from a change in the direction of air flow or a restriction that is too abrupt. Airflow noise can also result from structural components that are vibrated by the flow of air thereover, by natural resonances within the vent structure, and the like. Due to the higher flow velocities in the newer, smaller, cylindrical ducting designs, the potential for generating undesirable noise is increased.

To address this problem, Unico, Inc., assignee of U.S. Pat. No. 6,168,518 and assignee of the present application, developed a novel vent structure that connects between a small-diameter cylindrical airflow duct and a narrow rectangular outlet slot by way of a curved, angularly flared transition section that changes the direction of airflow and transitions from the circular cross section of the duct to the rectangular shape of the outlet slot with a minimum of turbulence and airflow noise. In developing the vent structure disclosed in U.S. Pat. No. 6,168,518, Unico determined that the cross sectional areas of the flared transition section and outlet section, in combination with the gradual curved shape of the flare section, minimized the introduction of turbulence in air flowing therethrough and, thereby, minimized the generation of airflow noise.

The present invention provides further improvements in such vent structures. One drawback to the newer, smaller-diameter, cylindrical ducting designs is that the high velocity flow through the ducts often causes air exiting an outlet vent or louver to be concentrated at a high velocity in a region of the outlet vent that is nearest to or aligned with the cylindrical ducting to which the vent structure is connected. That is, the air being discharged from an outlet vent or louver tends to have a non-uniform velocity profile (see FIG. 6).

Thus, there is a need for a vent structure that is configured to minimize the introduction of turbulence and resulting airflow noise, while providing a more uniform velocity profile of exiting air.

SUMMARY OF THE INVENTION

The present invention provides a vent structure for an HVAC system. In general, the vent structure comprises an inlet-connector section, an outlet section, and a transition section between the inlet-connector section and outlet section. The inlet-connector section is at an inlet end of the vent structure and is adapted for connection with an inlet duct from which the vent structure receives a flow of air. The outlet section is at an outlet end of the vent structure and includes an outlet slot that is adapted to direct the flow of air into a room. The transition section has a flared portion that diverges in cross-sectional area as it extends generally toward the outlet section. The transition section has a constricted portion located between the inlet-connector section and the outlet slot. The constricted portion is also located substantially centrally within a plane that is generally perpendicular to a direction of air flow. The constricted portion is adapted to restrict the flow of air through a central portion of the transition section, thereby restricting the flow of air exiting a corresponding central portion of the outlet slot.

In another aspect of the invention, a vent structure comprises an inlet-connector section, an outlet section, and a transition section. The inlet-connector section is substantially as described above. The outlet section is at an outlet end of the vent structure and includes a generally rectangular outlet slot adapted to direct the flow of air into a room. The outlet slot is defined by left and right end margins and generally parallel upper and lower margins. The upper and lower margins of the slot are longer in dimension than the left and right end margins, such that a width of the outlet slot is greater than a height of the outlet slot. The transition section is located between the inlet-connector section and the outlet section. The transition section has a flared portion that is defined by generally parallel upper and lower walls and left and ride side portions. The left and right side portions of the flared portion are angled relative to one another such that the flared portion diverges in width as it extends toward the outlet section. The upper and lower walls of the flared portion of the transition section are contoured in a manner to define a constricted portion of the transition section. The constricted portion is located generally centrally between the left and right side portions of the flared portion for restricting the flow of air through the constricted portion, and thereby restricting the flow of air exiting a corresponding generally central portion of the outlet slot.

In still another aspect of the invention, a vent structure includes an inlet-connector section, an outlet section, and a transition section, which provides fluid communication between the inlet-connector section and outlet section. The inlet-connector section and outlet section are substantially as described above. The transition section has a flared portion defined by upper and lower walls and left and right side portions. The left and right side portions are angled relative to one another such that the flared portion diverges in width as it extends toward the outlet section. At least one of the upper and lower walls of the flared portion has a protrusion that extends generally toward the other of the upper and lower walls. The protrusion extends in a manner to restrict a part of the flow of air through the flared portion, thereby restricting a corresponding part of the flow of air exiting the outlet slot.

Further objects, features, and advantages of the present invention, as well as the structure and operation of various embodiments of the present invention, are described in detail below with reference to the accompanying drawings.

Figure 1:
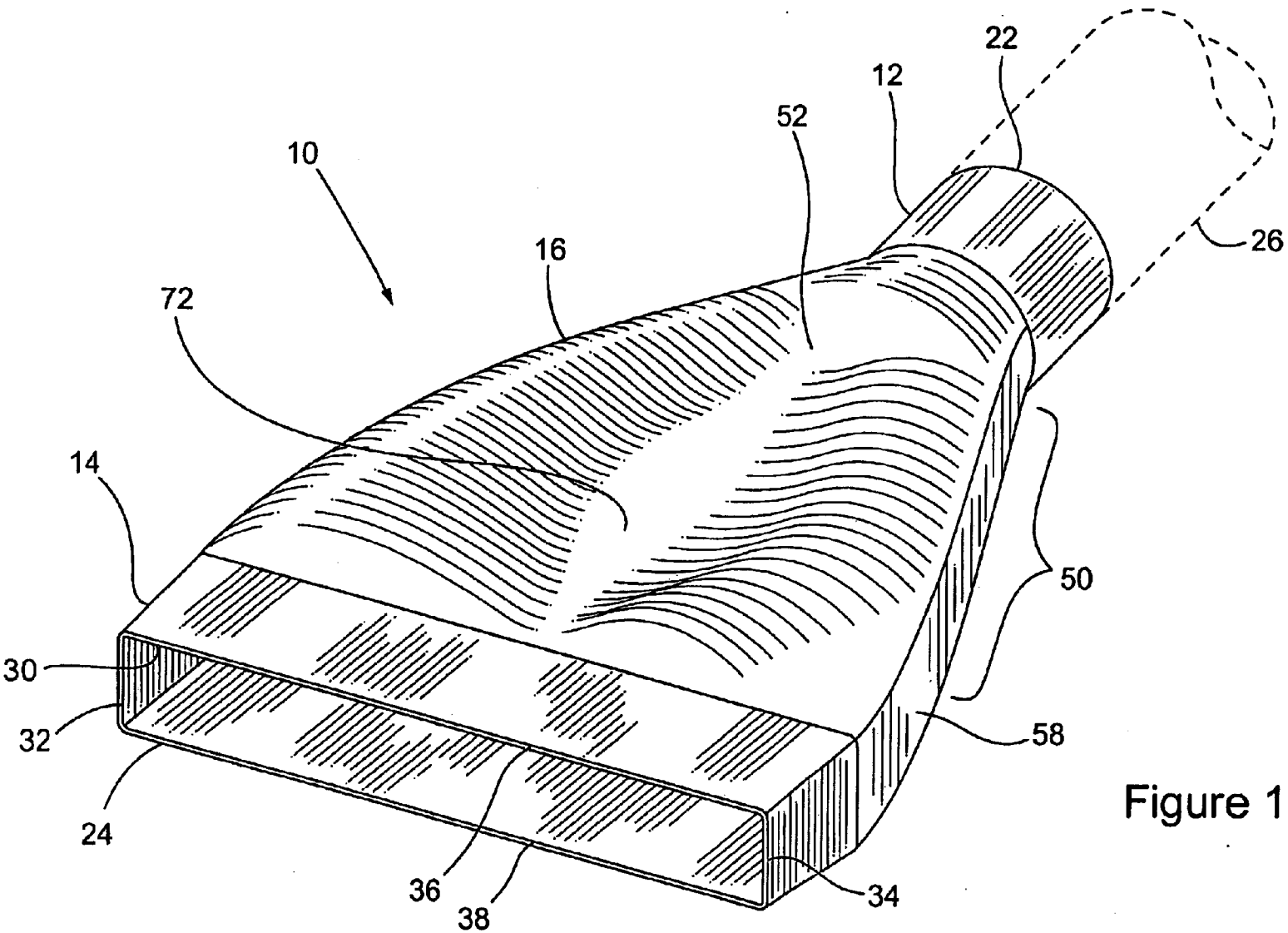
FIG. 1 is a perspective view of a vent structure of the present invention.

Reference characters used in these drawings correspond with reference characters used throughout the Detailed Description of the Preferred Embodiments, which follows. These drawings, which are incorporated in and form a part of the specification, illustrate the preferred embodiments of the present invention and, together with the description, serve to explain the principles of the invention.

DETAILED DESCRIPTION OF THE PREFERRED EMBODIMENTS

A vent structure of the present invention is represented generally in FIGS. 1 through 5 by the reference numeral 10. In general, the vent structure 10 comprises an inlet-connector section 12, an outlet section 14, and a transition section 16 located between the inlet-connector section and outlet section.

The inlet-connector section 12 is located at an inlet end 22 of the vent structure, and the outlet section 14 is located at an outlet end of the vent structure 24. The inlet-connector section is adapted for connection with an inlet duct 26 from which the vent structure 10 receives a flow of air. Preferably, the inlet-connector section 12 is adapted to receive air from the inlet duct 26 generally along an inlet axis A (see FIG. 5). The inlet duct 26 is supplied with air from an HVAC system (not shown). Preferably, the inlet-connector section 12 is adapted for connection with an inlet duct 26 of the type used the newer, smaller-diameter, cylindrical ducting designs configured for high velocity flow. Thus, preferably, the inlet-connector section 12 has a substantially cylindrical shape adapted to mate with the generally circular cross section of the an inlet duct 26. Of course, inlet-connector sections and corresponding inlet ducts having different shapes and configurations could be used without departing from the scope of the present invention as claimed.

Figure 3:
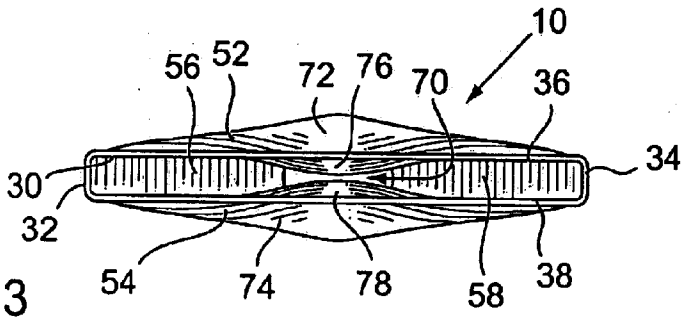
FIG. 3 is a front elevational view of the vent structure of FIG. 1.

The outlet section 14 preferably includes a generally rectangular outlet slot 30, which is adapted to direct the flow of air into a room or other area to be environmentally controlled. The rectangular outlet slot 30 is defined by left and right end margins 32 and 34 and generally parallel upper and lower margins 36 and 38. The upper and lower margins 36 and 38 of the slot 30 are preferably longer in dimension than the left and right end margins 32 and 34, such that, as best shown in FIGS. 1 and 3, the slot 30 is substantially wider than it is tall. Preferably, the cross-sectional area of the outlet slot 30 is greater than the cross-sectional area of the inlet-connector section 12, and preferably the width of the outlet slot 30 is greater than the diameter of the cylindrical inlet-connector section 12. The desirability of these relative dimensions and configurations is discussed below. Of course, outlet sections and outlet slots having different shapes and dimensions could be used without departing from the scope of the present invention as claimed.

Figure 2:
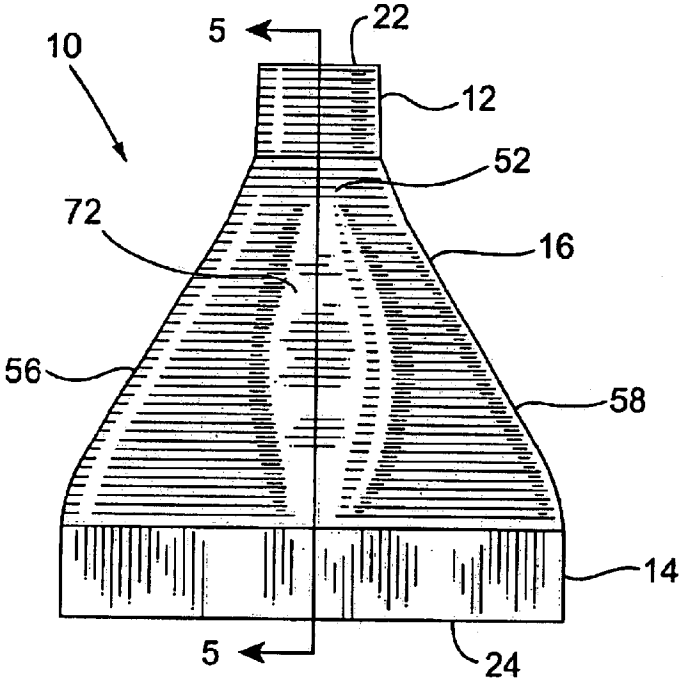
FIG. 2 is a top plan view of the vent structure of FIG. 1.

As shown in FIGS. 1, 2, 4 and 5, the transition section 16 is located between the inlet-connector section 12 and outlet section 14, and is adapted to provide fluid communication therebetween. That is, the transition section 16 is adapted to receive the flow of air from the inlet-connector section 12 and to carry it to the outlet section 14. Preferably, the transition section 16 has a flared portion 50, which is defined by generally parallel upper and lower walls 52 and 54 and left a rid right side portions 56 and 58, which connect the upper and lower walls 52 and 54 to one another. As best shown in FIGS. 1 and 2, the left and right side portions 56 and 58 of the flared portion 50 are preferably angled relative to one another such that the flared portion 50 diverges in width as it extends from the inlet-connector section 12 to the outlet section 14. Again, the upper and lower walls 52 and 54 of the flared portion 50 are preferably generally parallel with one another, so the angled left and right side portions 56 and 58 result in the flared portion 50 also diverging in cross-sectional area as it extends toward the outlet section 14.

The transitional section 16 of the vent structure of the present invention has many of the same advantages as the vent structure disclosed in U.S. Pat. No. 6,168,518, assigned to Unico, Inc. Both vent structures connect between a small-diameter cylindrical airflow duct and a narrow rectangular outlet slot by way of an angularly flared transition section, which smoothly transitions the air flow from the circular cross section of the inlet duct to the narrow rectangular shape of the outlet slot. By smoothly changing the shape of the air flow (from the cylindrical shape of the inlet duct to the narrow rectangular configuration of the outlet slot) and by providing an outlet section 14 with a greater cross-sectional area than the inlet-connector section 12, the creation of turbulence with the vent structure 10, and noise generated thereby, is greatly reduced.

Figure 5:
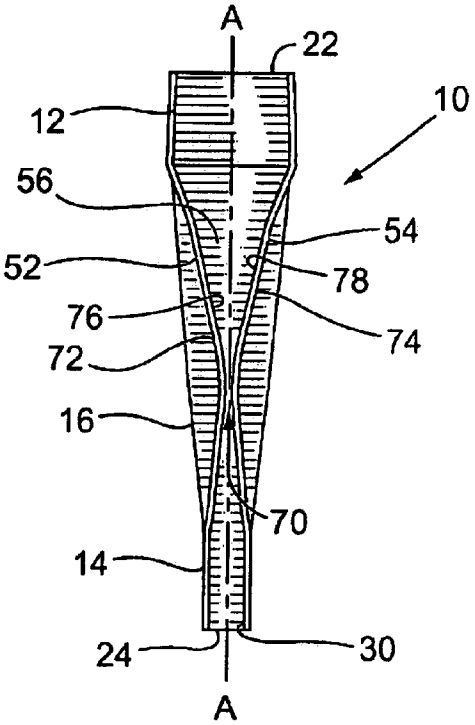
FIG. 5 is a cross-sectional side view of the vent structure taken along the plane of line A—A in FIG. 2.
Figure 4:
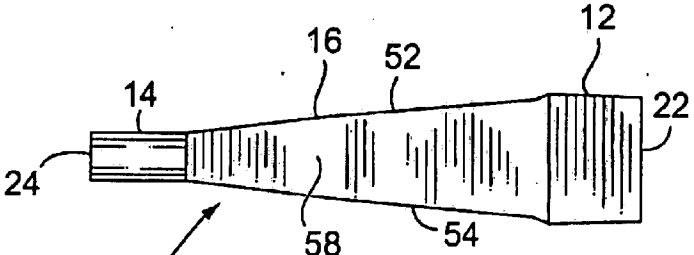
FIG. 4 is a side elevational view of the vent structure of FIG. 1.

As shown in FIG. 5, the inlet-connector section 12 is adapted to receive air from the inlet duct 26 generally along the inlet axis A. Preferably, the transition section 16 and outlet section 14 of the vent structure 10 are configured to maintain the direction of air flow generally along the inlet axis A. Unlike this preferred embodiment of the vent structure 10 of the present invention, the vent structure disclosed in U.S. Pat. No. 6,168,518 has a curved transition section, which changes the direction of air flow so that the air discharged from the outlet slot is substantially perpendicular to the air received from the inlet duct. However, it should be understood that, although the preferred embodiment of the present invention shown in FIGS. 1–5 does not include such a curved transition section, a curved transition section (having an angle of anywhere between 0 and 180 degrees) could be used with the vent structure 10 of the present invention, without departing from the scope of the invention as claimed.

To this point, the vent structure 10 described is similar to the vent structure disclosed in U.S. Pat. No. 6,168,518.

However, a desirable feature of the vent structure 10 of the present invention is a constricted portion 70 of the transition section 16 located between the inlet-connector section 12 and the outlet slot 14.

As best shown in FIGS. 3 and 5, the upper and lower walls 52 and 54 of the flared portion 50 of the transition section 16 are preferably contoured in a manner to define the constricted portion 70. More specifically, each of the upper and lower walls 52 and 54 of the flared portion 50 includes a depressed section 72 and 74, which form corresponding protrusions 76 and 78 on the interior surfaces of the upper and lower walls 52 and 54 that extend generally toward one another. Preferably, the constricted portion 70 is located midway between the left and right side portions 56 and 58 of the flared portion 50 for restricting the flow of air through a central portion of the transition section 16. Stated another way, the constricted portion 70 is preferably located substantially centrally within a plane that is generally perpendicular to a direction of air flow, to thereby restrict the flow of air through the central portion of the transition section 16. As explained below, this restriction of the flow of air through the central portion of the transition section 16 results in a restriction of the flow of air exiting a corresponding generally central portion of the outlet slot 30.

Again, the transition section 16 and outlet section 14 of the vent structure 10 are preferably configured to maintain the direction of air flow generally along the inlet axis A. In this preferred embodiment, the constricted portion 70 of the transition section 16 is preferably aligned with the inlet-connector section 12 in a manner so that the constricted portion 70 is located within a central portion of a flow path of air received from the inlet duct 26, generally along axis A shown in FIG. 5. However, as noted above, a curved transition section (having an angle of anywhere between 0 and 180 degrees) could be used with the vent structure 10 of the present invention, without departing from the scope of the invention as claimed. In such an alternative embodiment having a curved transition section, the constricted portion 70 is still preferably located relative to the inlet-connector section 12 such that it is within a central portion of a flow path of air received from the inlet duct 26, though that flow path may be correspondingly curved.

Whether the transition section 16 is curved (as described above) or straight (as shown in the Figures), the constricted portion 70 preferably restricts the flow of air through the central portion of the transition section 16, which results in a restriction of the flow of air exiting a corresponding generally central portion of the outlet slot 30. This, in turn, results in a more uniform velocity profile of air flow exiting the outlet slot 30.

Figure 6:
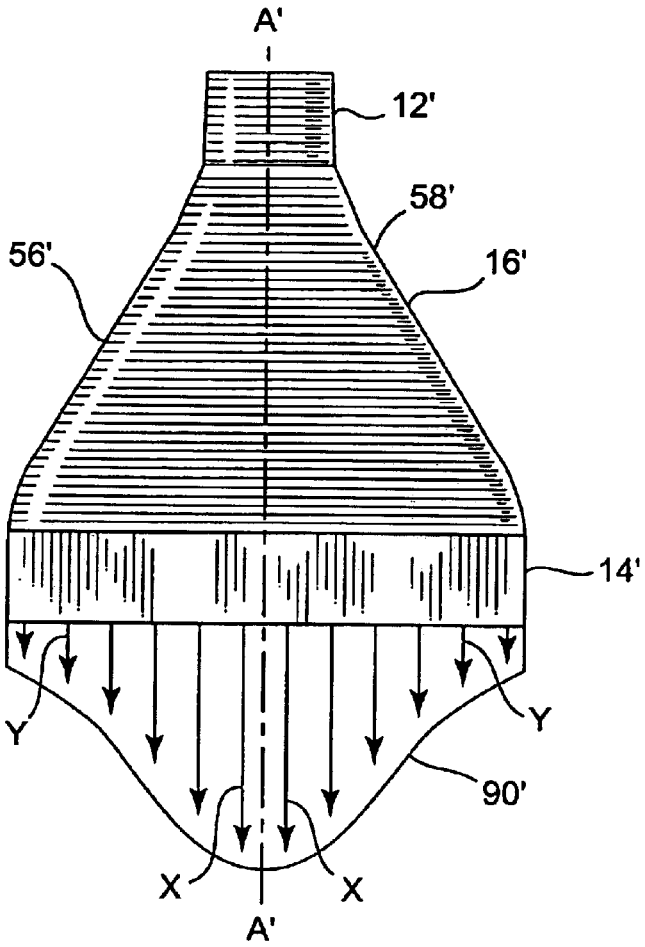
PRIOR ART Figure 6
FIG. 6 is a top plan view of a prior art vent structure, including a schematic representation of a velocity profile of air exiting the outlet slot.

FIG. 6 is a top plan view of a prior art vent structure, including a schematic representation of a velocity profile 90' of air exiting the outlet slot As shown in FIG. 6, the prior art vent structure 10' includes an inlet-connector section 12', a transition section 16' and an outlet section 14' that are all generally aligned with one another so that air flow is generally maintained in the direction of axis A'. Thus, a central portion of the outlet slot is aligned with the inlet-connector section 12', which puts it directly in the flow path of air flowing from the inlet-connector section 12'. While the diverging width of the transition section 16' results in some lateral diffusion of the air flowing from the inlet duct, because of the high velocity of the air flow received from the inlet duct, the flow is concentrated at a central portion of the vent structure, generally along axis A'. Consequently, the flow velocity of air exiting the outlet section 14' tends to be much greater at a central portion of the outlet section 14' adjacent to axis A' (the higher velocity air is represented by longer arrows X) and flow velocity of exiting air tends to be lower toward left and right side portions 56' and 58' of the transition section 16' (the lower velocity air is represented by shorter arrows Y). Thus, velocity profile 90' is not uniform.

Figure 7:
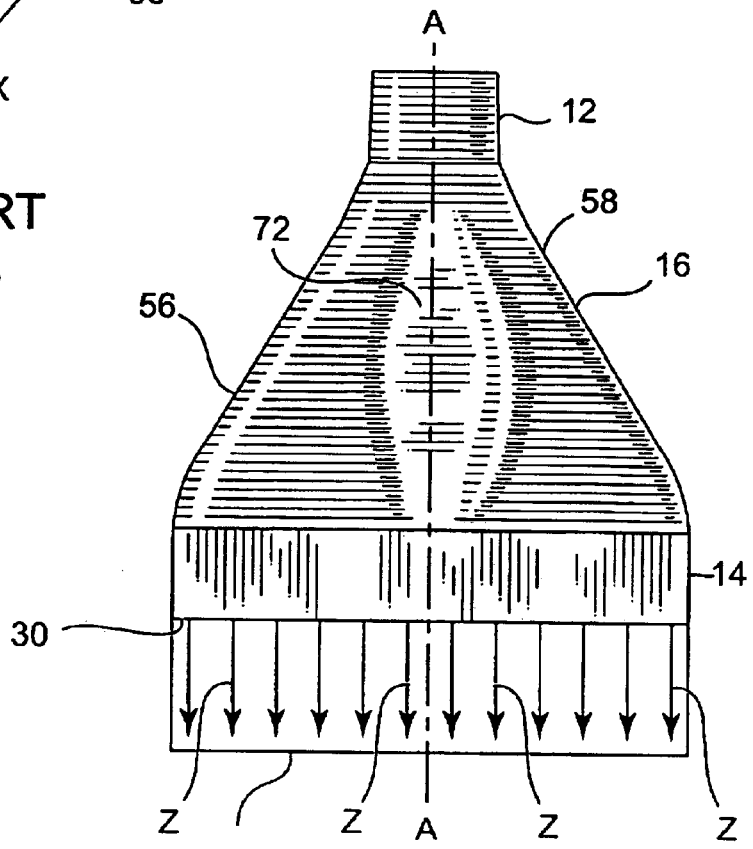
FIG. 7 is a top plan view of the vent structure of the present invention similar to FIG. 2, but including a schematic representation of a theoretically ideal uniform velocity profile of air exiting the outlet slot.

FIG. 7 is a top plan view of the vent structure 10 of the present invention, including a schematic representation of a theoretically ideal uniform velocity profile 100 of air exiting the outlet slot 30. Again, in the preferred embodiment of the invention, the inlet-connector section 12, transition section 16 and outlet section 14 are all generally aligned with one another, such that a central portion of the outlet slot 30 is aligned with the inlet-connector section 12. However, the constricted portion (see FIGS. 3 and 5) interrupts the flow path of air between the inlet-connector section 12 and outlet section 14, and thus reduces the velocity of air exiting a generally central portion of the outlet slot 30. Some of the air flow that would otherwise proceed generally along axis A is diverted laterally (to the left or to the right of axis A as shown in FIG. 7), thus increasing the velocity of air exiting lateral portions of the outlet section 14. This, coupled with the diverging width of the transition section 16, results in a much more uniform velocity profile 100, with flow velocity of air exiting the outlet section 14 being generally the same at a central portion of the outlet section 14 adjacent to axis A as it is adjacent left and right side portions 56 and 58 of the transition section 16 (the air at uniform flow velocity is represented by arrows Z). Again, FIG. 7 represents a theoretically ideal uniform velocity profile, with the velocity of air being equal along the entire width of the outlet slot 30. In practice, such perfect uniformity would be difficult to achieve, and is not necessary to benefit from the improvement provided by the present invention.

Figure 8:
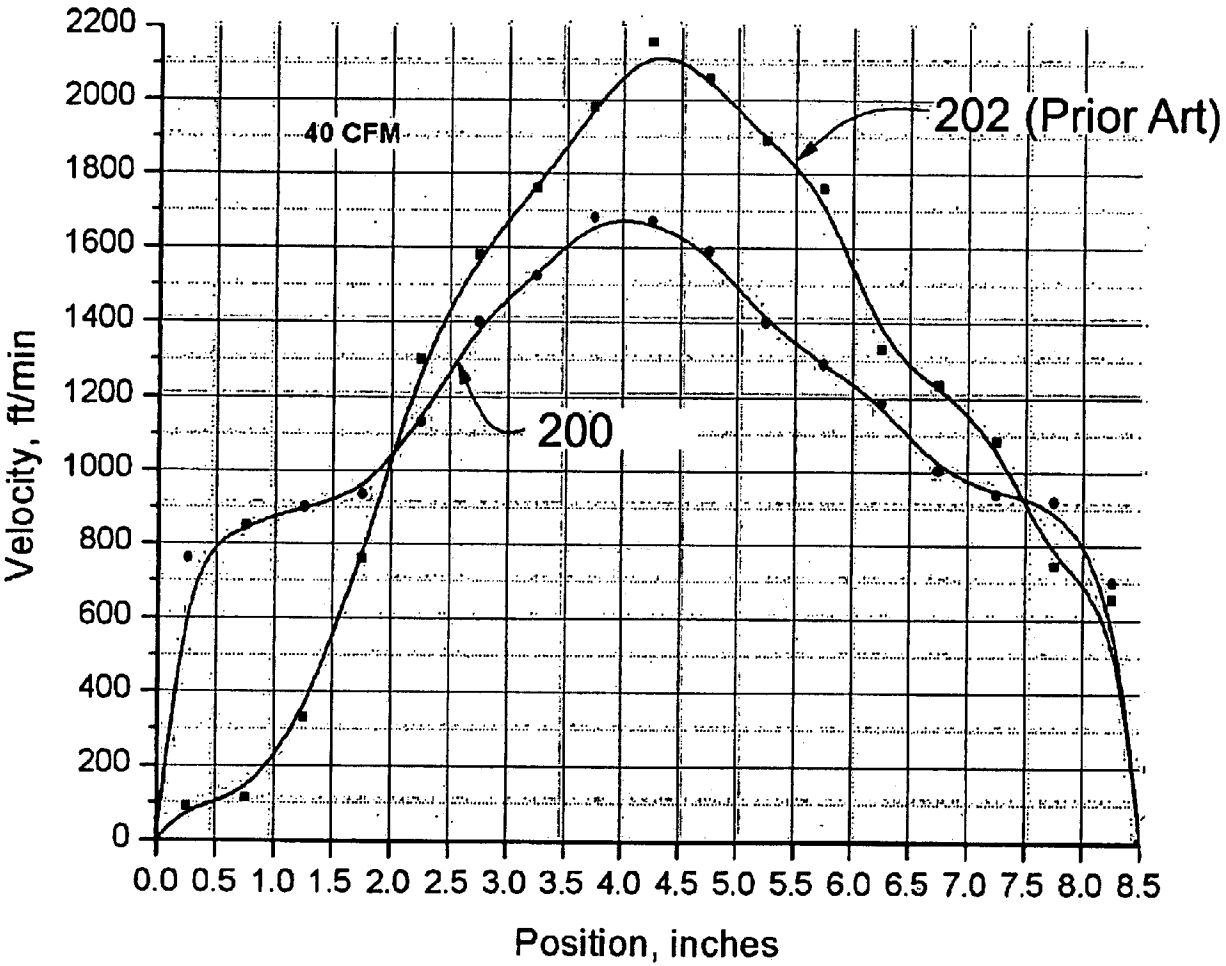
FIG. 8 is a graphical representation of the results of one specific application of the present invention, as compared to the prior art.

FIG. 8 is a graphical representation of one specific application of the present invention to a vent structure that is 8.5 inches wide at a flow rate of 40 cubic feet per minute, and shows exemplary data for a velocity profile 200 produced by a vent structure embodying the present invention, as compared to a velocity profile 202 of a prior art vent structure having no restricted portion. While not perfectly uniform across the width of the vent structure, the profile 200 is substantially more uniform across the width of the outlet slot 30 than the velocity profile 202 of the prior art vent structure. Again, this is one exemplary set of data from a specific application of the present invention to one vent structure, and is not intended to limit the breadth or scope of the present invention, which is defined solely by the claims appended hereto and their equivalents.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A vent structure for an air handling system, the vent structure comprising:

an inlet-connector section at an inlet end of the vent structure, the inlet-connector section being adapted for connection with an inlet duct from which the vent structure receives a flow of air;

an outlet section at an outlet end of the vent structure, the outlet section including an outlet slot adapted to direct the flow of air into a room; and a transition section between the inlet-connector section and outlet section, the transition section having a flared portion that diverges in cross-sectional area as it extends generally toward the outlet section, the transition section having a constricted portion located between the inlet-connector section and the outlet slot and located substantially centrally within a plane that is generally perpendicular to a direction of air flow, the constricted portion being adapted to restrict the flow of air through a central portion of the transition section, thereby restricting the flow of air exiting a corresponding central portion of the outlet slot.

2. The vent structure of claim 1 wherein a cross-sectional area of the outlet slot is greater than a cross-sectional area of the inlet connector section.

3. The vent structure of claim 1 wherein the inlet-connector section has a substantially cylindrical shape adapted to mate with an inlet duct having a generally circular cross section.

4. The vent structure of claim 3 wherein a width of the outlet slot is greater than a diameter of the cylindrical inlet-connector section.

5. The vent structure of claim 3 wherein the outlet slot has a generally rectangular configuration and wherein the transition section is shaped and configured to provide a smooth transition between the circular cross section of the inlet duct and the generally rectangular configuration of the outlet slot.

6. The vent structure of claim 1 wherein the constricted portion of the transition section is generally aligned with the inlet connector section in a manner so that the constricted portion is located within a central portion of a flow path of air received from the inlet duct.

7. The vent structure of claim 1 wherein the inlet-connector section is adapted to receive air from an inlet duct generally along an inlet axis, and wherein the transition and outlet sections of the vent structure are configured to maintain the direction of air flow generally along the inlet axis.

8. The vent structure of claim 7 wherein the constricted portion of the transition section lies generally along the inlet axis.

9. The vent structure of claim 1 wherein the outlet slot has a generally rectangular configuration defined by left and right end margins and generally parallel upper and lower margins, the upper and lower margins of the slot being longer in dimension than the left and right end margins such that a width of the outlet slot is greater than a height of the outlet slot, and wherein the flared portion of the transition section is defined by generally parallel upper and lower walls and left and right side portions, the left and right side portions being angled relative to one another such that the flared portion diverges in width as it extends toward the outlet section.

10. The vent structure of claim 9 wherein the constricted portion of the transition section is defined by the upper and lower walls of the flared portion, which are contoured in a manner to restrict the flow of air through the central portion of the transition section and thereby provide a generally uniform velocity profile of air flow exiting the outlet slot.

11. A vent structure for an air handling system, the vent structure comprising:

an inlet-connector section at an inlet end of the vent structure, the inlet-connector section being adapted for connection with an inlet duct from which the vent structure receives a flow of air;

an outlet section at an outlet end of the vent structure, the outlet section including a generally rectangular outlet slot adapted to direct the flow of air into a room, the outlet slot being defined by left and right end margins and generally parallel upper and lower margins, the upper and lower margins of the slot being longer in dimension than the left and right end margins such that a width of the outlet slot is greater than a height of the outlet slot; and a transition section between the inlet-connector section and outlet section, the transition section having a flared portion defined by generally parallel upper and lower walls and left and right side portions, the left and right side portions of the flared portion being angled relative to one another such that the flared portion diverges in width as it extends toward the outlet section, the upper and lower walls of the flared portion of the transition section being contoured in a manner to define a constricted portion of the transition section located generally centrally between the left and right side portions of the flared portion for restricting the flow of air through the constricted portion, thereby restricting the flow of air exiting a corresponding generally central portion of the outlet slot.

12. The vent structure of claim 11 wherein a cross-sectional area of the outlet slot is greater than a cross-sectional area of the inlet connector section.

13. The vent structure of claim 11 wherein the inlet-connector section has a substantially cylindrical shape adapted to mate with an inlet duct having a generally circular cross section.

14. The vent structure of claim 13 wherein the transition section is shaped and configured to provide a smooth transition between the circular cross section of the inlet duct and the generally rectangular outlet slot.

15. The vent structure of claim 11 wherein the constricted portion of the transition section is generally aligned with the inlet-connector section in a manner so that the constricted portion is located within a central portion of a flow path of air received from the inlet duct.

16. The vent structure of claim 11 wherein the inlet-connector section is adapted to receive air from an inlet duct generally along an inlet axis, and wherein the transition and outlet sections of the vent structure are configured to maintain a direction of flow generally along the inlet axis.

17. The vent structure of claim 16 wherein the constricted portion of the transition section lies generally along the inlet axis.

18. A vent structure for an air handling system, the vent structure comprising:

an inlet-connector section at an inlet end of the vent structure, the inlet-connector section being adapted for connection with an inlet duct from which the vent structure receives a flow of air;

an outlet section at an outlet end of the vent structure, the outlet section including a generally rectangular outlet slot adapted to direct the flow of air into a room, the outlet slot being defined by left and right end margins and generally parallel upper and lower margins, the upper and lower margins of the slot being longer in dimension than the left and right end margins such that a width of the outlet slot is greater than a height of the outlet slot; and a transition section adapted to provide fluid communication between the inlet-connector section and outlet section, the transition section having a flared portion defined by upper and lower walls and left and right side portions, the left and right side portions being angled relative to one another such that the flared portion diverges in width as it extends toward the outlet section, at least one of the upper and lower walls of the flared portion having a protrusion that extends generally toward the other of the upper and lower walls in a manner to restrict a part of the flow of air through the flared portion, thereby restricting a corresponding part of the flow of air exiting the outlet slot.

19. The vent structure of claim 18 wherein the protrusion occupies a generally central portion of a flow path of air through the flared portion so that a corresponding central part of the flow of air exiting the outlet slot is restricted, thereby providing a generally uniform velocity profile of air flow exiting the outlet slot.

20. The vent structure of claim 18 wherein the inlet-connector section has a substantially cylindrical shape adapted to mate with an inlet duct having a generally circular cross section.

21. The vent structure of claim 20 wherein the transition section is shaped and configured to provide a smooth transition between the circular cross section of the inlet duct and the generally rectangular outlet slot.

22. The vent structure of claim 18 wherein each of the upper and lower walls of the flared portion includes a protrusion that extends generally toward the other of the upper and lower walls in a manner to restrict the part of the flow of air through the flared portion.

23. The vent structure of claim 22 wherein the protrusions are defined by contoured portions of the upper and lower walls of the flared portion, which define a constricted portion of the transition section, which restricts the flow of air passing through the constricted portion, thereby restricting the flow of air exiting a corresponding portion of the outlet slot.

24. The vent structure of claim 23 wherein the constricted portion is generally aligned with the inlet-connector section in a manner so that the constricted portion is located generally within a center of the flow path of air received from the inlet duct.

25. The vent structure of claim 18 wherein the inlet-connector section is adapted to receive air from an inlet duct generally along an inlet axis, and wherein the transition and outlet sections of the vent structure are configured to maintain a direction of flow generally along the inlet axis.

26. The vent structure of claim 25 wherein the constricted portion lies generally along the inlet axis.

* * * * *